United States Patent [19]

Lillibridge

[11] 4,134,322

[45] Jan. 16, 1979

[54] USE OF MICROENCAPSULATED GLUE IN THE MANUFACTURE OF ENVELOPES

[75] Inventor: Harold R. Lillibridge, San Mateo, Calif.

[73] Assignee: Champion International Corporation, Stamford, Conn.

[21] Appl. No.: 810,264

[22] Filed: Jun. 27, 1977

[51] Int. Cl.[2] ..... B31B 19/60

[52] U.S. Cl. ..... 93/61 R; 93/62; 93/74; 428/307

[58] Field of Search ..... 93/61 R, 62, 74; 229/80; 428/307

[56] References Cited

U.S. PATENT DOCUMENTS

| | | | |
|---|---|---|---|
| 2,420,963 | 5/1947 | Malo | 229/80 |
| 2,986,477 | 5/1961 | Elchel | 428/307 |
| 4,055,111 | 10/1977 | Howatt | 93/61 R |

*Primary Examiner*—James F. Coan

*Attorney, Agent, or Firm*—Evelyn M. Sommer

[57] ABSTRACT

Envelopes having moistenable gum on the seal flap and back gum adhering the sides and bottom are manufactured by a process comprising applying a back gum to either the bottom flap or the side flaps in the form of microcapsules. When the bottom and side flaps are folded and pressure is applied, the microcapsules rupture causing the back gum to adhere the bottom and side flaps. Gum in the form of microcapsules can also be applied to the seal flap allowing the end user to seal without moisture.

4 Claims, 3 Drawing Figures

USE OF MICROENCAPSULATED GLUE IN THE MANUFACTURE OF ENVELOPES

BACKGROUND OF THE INVENTION

This invention relates to improvements in the process for manufacturing paper envelopes and the like. More particularly, it relates to the use of a microencapsulated glue in the manufacturing process.

In the manufacture of envelopes from an envelope sheet, two kinds of glue are normally used. For the bottom and side portions which are "permanently" sealed together, a back gum containing from about 60 to about 70 percent of solids is used. On the envelope flap, a remoistenable seal gum is applied. In the process of manufacture normally used, the first step is to apply the remoistenable seal gum to the portion of the envelope sheet, which will later become the lid of the envelope. This is done, for example, by collating a number of envelope sheets so that approximately 9/16 inches of the lid portion of each envelope sheet is exposed. The glue, in liquid suspension, can then be conveniently rolled on. The coated envelope sheet is then dried. Each envelope sheet is then scored in the places where folds are desired and back gum is applied to the portion of the envelope sheet where the bottom flap and the side flaps will be sealed. The back gum is also applied in liquid suspension or solution. The bottom and sides are then immediately folded up to finish the envelope.

One of the disadvantages of this process is that, once the back gum is applied, the bottom and side flaps must be immediately folded up and sealed. For reasons of storage and handling, it would be desirable to be able to apply the back gum without immediately folding the bottom and side flaps. At the present time, it is not possible to collate envelope sheets on which both the seal gum and the back gum has been applied.

It would also be advantageous to apply the seal gum in the form of microcapsules to the seal flap as this would permit the end user to seal the envelope without moisture. This feature would be of particular advantage to large mailers using inserting machines.

It is therefore a principal object of this invention to provide a more flexible process for the manufacture of envelopes in which both the seal gum and the back gum can be applied to the envelope sheet and the sheets then collated without first having to perform the step of sealing the bottom and sides.

SUMMARY OF THE INVENTION

This invention provides an improvement in the process for manufacturing envelopes whereby the back gum is microencapsulated. A suspension of the microcapsules is applied to the appropriate area on the envelope sheet prior to the drying of the seal gum. Both adhesives are dried at the same time and the envelope sheet can be collated without first having to fold the bottom and sides. When it is desired to finish the manufacturing process, the bottom and sides are folded and appropriate pressure is applied. The microcapsules on the bottom are ruptured thereby spreading the gum and causing adhesion.

DETAILED DISCLOSURE

The encapsulating material for the back gum should be of a hydrophobic nature; i.e., it should be water insoluble. The encapsulating material can be a thermoplastic resin containing non-ionizable groups, examples of which are polyvinyl chloride, polystyrene, polyvinyl acetate, vinylchloride—vinylidene chloride copolymers, cellulose acetate and ethyl cellulose. The critical feature in choosing the encapsulating material, in addition to water insolubility, is the rupture point of the capsule. It is important that the capsule shall be able to contain the back gum up to the point of pressure employed in the folding and sealing step. It is also important that the melting point of the encapsulating material be sufficiently high so that it will not melt during ordinary storage conditions; thus, the melting point of the encapsulating material should be about 50° C. The rupture point for the capsule should be below about 50 psi; i.e. between about 5 to 50 psi. The microcapsules have been more fully described in U.S. Pat. No. 3,875,074 filed Apr. 1, 1975 and U.S. Pat. No. 3,886,084 filed May 27, 1975 by applicant's assignee.

In the process of this invention, the envelope sheet is coated in the appropriate places with solutions or suspensions of the seal gum and of the microencapsulated backing gum. After both of the adhesives are applied, the envelope sheet is then dried by suitable means until the carrier or solvents for both adhesives have evaporated.

If it is desired to complete the manufacturing process at this time, the envelope sheet is then scored in the appropriate places for folds. The bottom and sides are folded and pressure is applied in sufficient amounts to break the microcapsules, thereby freeing the gum and causing adhesion of the bottom and sides.

If, on the other hand, it is desired to store the adhesive coated envelope sheets, this can be immediately done without running the risk of having the envelope sheets adhere to one another. The sheets can be stored either immediately after the drying step or after the scoring step.

Figure 3:
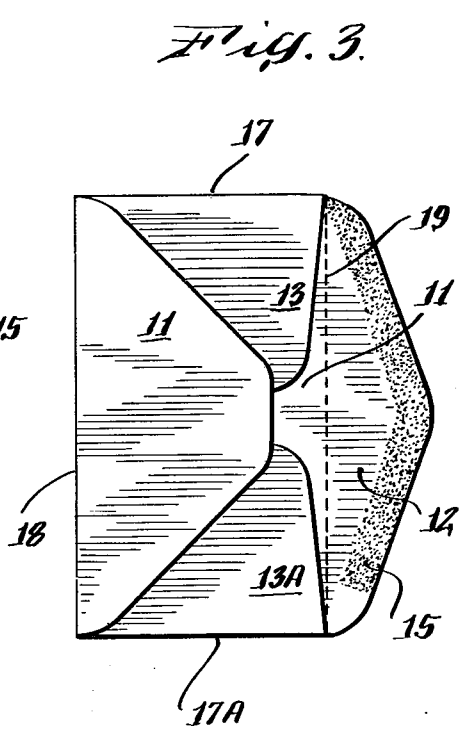
FIG. 3 shows the completed envelope.
Figure 2:
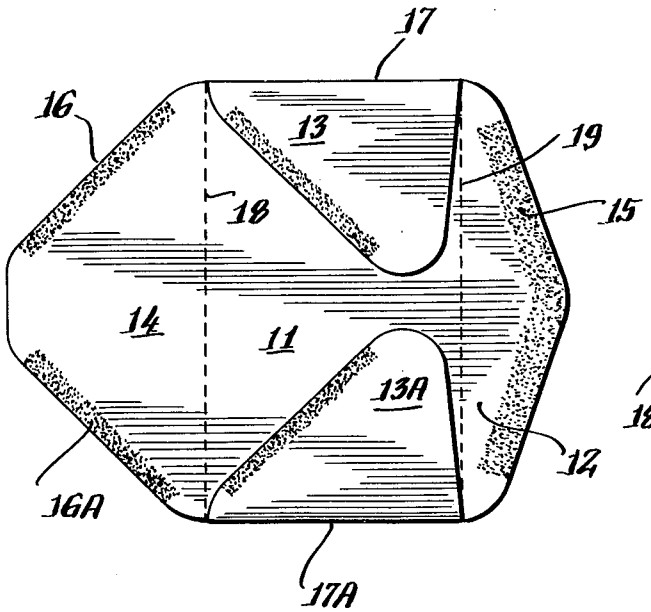
FIG. 2 shows an envelope sheet in which the two side flaps have been folded over.
Figure 1:
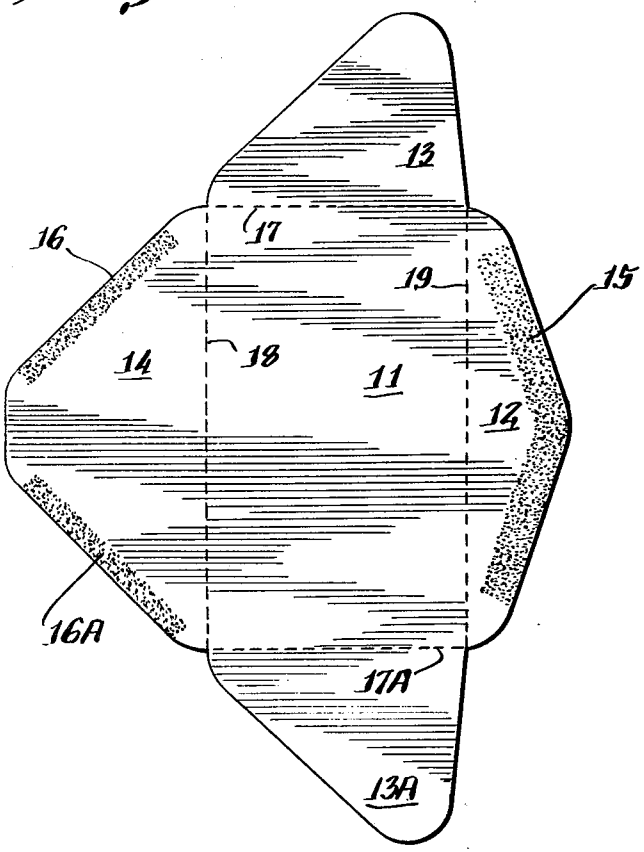
FIG. 1 shows an envelope sheet having a lid portion, a bottom flap and two side flaps.

This invention will be better understood with reference to the associated drawings, which show a preferred embodiment of this invention. FIG. 1 represents an envelope sheet. FIG. 2 shows a partially folded envelope sheet. FIG. 3 shows an envelope manufactured by the process of this invention. In all of the FIGURES identical parts are represented by the same reference numerals.

An envelope sheet has main body portion 11, lid portion 12, side flaps 13 and **13*a* and bottom flap 14. Along the edge of lid portion 15, which in an ordinary envelope for business correspondence is about 3/16 inches wide, there is applied a seal gum. The seal gum can be a vinyl dextrin blend preparation such as is readily available from National Starch & Chemical Corporation, 750 Third Avenue, New York, N.Y. and Stern Hall & Co., Inc., 605 Third Avenue, New York, N.Y. Along the edge portion 16 and 16*a* of bottom flap 14, there is applied a microencapsulated suspension of back gum. The back gum can be any of the conventionally and readily available gums as used in the envelope trade, for instance. The width of this edge is, for an ordinary business envelope, typically about 3/16 of an inch, but this width can vary widely. It is important that the microcapsule suspension be applied only to the area of bottom flap 14 in which adhesion to side flaps 13 and 13***a* is desired. The microencapsulated gum should not be applied to any portions of bottom flap 14 which will contact main body 11 directly.

Both the seal gum applied to portion 15 and the microencapsulated back gum applied to portions 16 and 16*a* can be applied simultaneously or one can be applied after the other. After both have been applied, the envelope sheet is dried until the carrier or solvent for the seal gum and the microencapsulated back gum have evaporated.

Envelope sheets so treated may be stored in collated arrangement without running the risk of having the sheets adhere to each other. Either before or after such storage, the envelope sheet is scored along lines 17, 17*a*, 18 and 19 for folding.

When it is desired to assemble the envelope, side flaps 13 and 13*a* are folded in along lines 17 and 17*a* respectively, as shown in FIG. 2. Then bottom flap 14 is folded along line 18 so that edges 16 and 16*a*, which are coated with the microcapsules containing back gum contact edge portions 20 and 20*a*, respectively, of side flaps 13 and 13*a*. Pressure in the range of about 5 to 50 psi is then applied to the contact areas of edges 16 and 20 and on edges 16*a* and 20*a*. The pressure causes the microcapsules to rupture, thereby releasing the back gum and adhering bottom flap 14 to side flaps 13 and 13*a*.

As noted above, the micro-encapsulated glue can be applied to the seal (lid) of the envelope, permitting the end user to seal without the application of moisture.

What is claimed is:

1. In a process for manufacturing envelopes comprising applying a remoistenable seal gum to the lid thereof and applying a back gum thereof to the side or bottom flaps, drying the seal gum and applying pressure to fold the side and bottom flaps so as to cause adhesion therebetween, the improvement which comprises applying substantially simultaneously said back gum in the form of microcapsules contained in said gum, the microcapsules being subject to rupture at a pressure above about 5 psi, and said seal gum.

2. A process for manufacturing envelopes comprising the steps of (1) coating a remoistenable seal gum to the lid portion of an envelope sheet, (2) coating a microencapsulated back gum to the side portion or bottom portion of the envelope sheet, said back gum being applied to the portion of the envelope sheet where contact between the side and bottom portion is to occur, said steps (1) and (2) performed substantially simultaneously, (3) drying the envelope sheet, (4) scoring the envelope sheet along lines defining the configuration of the envelope, (5) folding the envelope along the scored lines forming the bottom and sides of the envelope, and (6) applying sufficient pressure to the area coated with the microencapsulated back gum so as to cause rupture of the microcapsules and adhesion of the bottom and side portions of the envelope.

3. A process according to claim 2 in which the microencapsulated back gum is coated on the bottom portion of the envelope sheet.

4. In a process for manufacturing envelopes comprising applying a remoistenable seal gum to the lid thereof and applying a back gum thereof to the side or bottom flaps, drying the seal gum and applying pressure to fold the side and bottom flaps so as to cause adhesion therebetween, the improvement which comprises applying at least one of said seal gum and back gum in the form of microcapsules contained in said gum, the microcapsules being subject to rupture at a pressure above about 5 psi, said seal gum and said back gum being applied substantially simultaneously.

* * * * *